US006336274B1

(12) United States Patent
Ness Webster

(10) Patent No.: US 6,336,274 B1
(45) Date of Patent: Jan. 8, 2002

(54) RIGHT ANGLE GRAPHING TEMPLATE

(76) Inventor: Sandra L. Ness Webster, 456 Hayter Dr., Morristown, TN (US) 37813

( * ) Notice: Subject to any disclaimer, the term of this patent is extended or adjusted under 35 U.S.C. 154(b) by 0 days.

(21) Appl. No.: 09/626,235

(22) Filed: Jul. 26, 2000

(51) Int. Cl.[7] ..... B43L 7/027
(52) U.S. Cl. ..... 33/474; 33/476; 434/205
(58) Field of Search ..... 33/472, 429, 476, 33/480, 483, 485, 494, 534, 679.1, 562, 563, 574, 492, 493, 498, 499; 434/85, 87, 88, 90–92, 211–216

(56) References Cited

U.S. PATENT DOCUMENTS

| | | | | | |
|---|---|---|---|---|---|
| 293,497 | A | * | 2/1884 | Nash | 33/474 |
| 373,929 | A | * | 11/1887 | Gillette | 33/474 |
| 583,058 | A | * | 5/1897 | King | 33/474 |
| 686,240 | A | * | 11/1901 | Whitehill | 33/474 |
| 1,176,026 | A | * | 3/1916 | Boone | 33/476 |
| 1,189,655 | A | * | 7/1916 | Bittner | 33/476 |
| 1,288,331 | A | * | 12/1918 | White | 33/474 |
| 1,778,922 | A | * | 10/1930 | Tait et al. | 33/476 |
| 4,221,057 | A | * | 9/1980 | Luikart | 33/494 |
| 4,625,425 | A | * | 12/1986 | Senno et al. | 33/477 |
| 4,821,424 | A | * | 4/1989 | Loggins | 33/474 |
| 4,936,020 | A | | 6/1990 | Neblett | |
| 4,999,922 | A | * | 3/1991 | Loggins | 33/474 |
| 5,090,129 | A | | 2/1992 | Cunningham | |
| 5,140,755 | A | | 8/1992 | Simmons, Jr. | |
| 5,239,762 | A | | 8/1993 | Grizzell | |
| 5,269,066 | A | * | 12/1993 | Walters | 33/476 |
| 5,404,648 | A | | 4/1995 | Taylor, Jr. | |
| 5,419,054 | A | | 5/1995 | Stoneberg | |
| 5,666,737 | A | * | 9/1997 | Ryan, III | 33/562 |

OTHER PUBLICATIONS

ETA Secondary Math Catalog 2000, pp. 24–26, 30, 44, Vernon Hills, IL.

* cited by examiner

*Primary Examiner*—Diego Gutierrez
*Assistant Examiner*—Mirellys Jagan
(74) *Attorney, Agent, or Firm*—Pitts & Brittian, P.C.

(57) ABSTRACT

A right angle graphing template useful for teaching students of various grade levels mathematical concepts, including concepts related to algebra and calculus. The template has first and second elongated ruler portions oriented perpendicular to one another and connected at an end to form a right angle. Each ruler portion has an inside scribing edge and a parallel outside scribing edge. A linear marking is placed within each ruler portion between and parallel to the inside and outside scribing edges. A vertex port is then placed at the point of intersection of the two linear markings. Finally, each ruler portion has a series of cross-markings perpendicular to the respective linear markings. The right angle graphing template allows the math student to quickly and accurately identify corresponding values in the domain and range of a function. This, in turn, assists students in learning mathematical principles such as rate-of-change which are demonstrated graphically.

1 Claim, 5 Drawing Sheets

RIGHT ANGLE GRAPHING TEMPLATE

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of Invention

The present invention relates to templates. More specifically, the present invention relates to a right angle template useful for teaching students of various grade levels mathematical concepts, including concepts related to algebra and calculus.

2. Description of the Related Art

The use of templates to assist in graphing mathematical formulas or functions is well-known. A template having a straight-edge for drawing a straight line on a graph is particularly well-known. Such straight edges may be used to connect plots on a graph, thereby drawing a line which represents the relationship between two variables on a graph. Such straight edges may also be used to draw a tangent line or "slope" at a point on a graph defining a polynomial function.

The use of graphs to visually define binomial and polynomial equations is frequently used to teach principles in algebra, calculus, and other mathematical fields of study. For example, students are taught in algebra that the equation of a line is defined as:

$$y=mx+b$$

where y is a value in the range of an equation, x is a value in the domain of an equation, m is the slope, and b is the "y-intercept." Students may be asked to determine the value b in this equation by graphing a series of known values represented by $(x_1, y_1)$, $(x_2, y_2)$, etc. In this instance, the value of the y-intercept is determined manually by actually plotting the given $x_n$ and $y_n$ points on a graph, and extrapolating the line defined by connecting those points across x=0.

Alternatively, students may be given only one point, defined as $(x_1, y_1)$, along with the value of m or b. A line could then be graphically created based upon these known values. As another exercise, a student may simply be given a line on a graph, and then asked to calculate slope by correlating pairs of x and y values. This is done using the formula:

$$m = \frac{(y_2 - y_1)}{(x_2 - x_1)}$$

The process of graphing lines in algebra enables students to depict real-world phenomena, such as the relationship between the height of a tree and its diameter. In this way, students can apply the concept of slope to represent rate of change in a real-world situation.

Students also learn to make predictions from a linear data set using a line of best fit. In this regard, graphing allows one to interpolate and extrapolate corresponding values of x and y which are not directly given based upon points which are given. A student can then estimate the values of the domain and range of a function at various points on a graph.

In the context of calculus, the slope of a polynomial function at a particular point f(x), defined as f'(x), represents the rate of change at a particular point in time. This is known as the derivative of a function. The derivative can typically be determined mathematically by using, for example, the limiting formula $$f'(x) = \frac{dx}{dy} = \lim_{h \to 0} \frac{f(x+h) - f(x)}{(x+h) - x}.$$

However, as a teaching aid, the derivative can also be determined geometrically by actually drawing a tangent line at a point, $(x_n, y_n)$ and then determining $(x_1, y_1)$ and $(x_2, y_2)$ values. Using again the formula:

$$m = \frac{(y_2 - y_1)}{(x_2 - x_1)}$$

the mathematical value of the derivative, or rate of change at a point in time, can be calculated without mathematically calculating the derivative directly. Whether the value of m is positive or negative also determines whether the rate of change is increasing or decreasing.

As another exercise, the derivative of an equation can be demonstrated geometrically through the use of a secant line. For example, if a curve C has equation y=f'(x), and the student wishes to find the tangent to C at the point P(a, f(a)), then we consider a nearby point Q(x, f(x)), where x≠a, and compute the slope of the secant line PQ:

$$m_{PQ} = \frac{f(x) - f(a)}{x - a}.$$

The student is then shown that as Q approaches P along the curve C by letting x approach a, then the value of $m_{PQ}$ approaches the actual tangent line of curve C at P. Hence, a graphical demonstration of $m_{PQ}$ as Q approaches P forms an important teaching device. This, again, is the mathematical value of the derivative f'(x) at P.

When performing the graphing exercises discussed, it is important for students to be able to accurately identify x and y values. In order to accurately identify corresponding x and y values on a graph, it is necessary that the student align a straight-edge in a direction which is exactly perpendicular to the respective x and y axis. However, those skilled in the art will understand that the process of identifying corresponding x and y values simply by using a straight-edge is not always accurate, as it is very difficult to make the required perpendicular alignments. More accurate measurements can sometimes be made by taking unusual time and care in the alignments. However, even this does not guarantee a result within what may be a required range of accuracy.

Right angle templates in the form of drafting squares, T-squares, and carpenter's squares are available. These are used by architects, draftspersons, carpenters, and the like in laying out construction plans. Such devices are disclosed in U.S. Pat. No. 5,419,054 issued in 1995 to Stoneberg, U.S. Pat. No. 5,239,762 issued in 1993 to Grizzell, U.S. Pat. No. 5,140,755 issued in 1992 to Simmons, and U.S. Pat. No. 5,090,129 issued in 1992 to Cunningham. However, these devices are cumbersome and are not practical to the algebra or calculus student who seeks to obtain quick and accurate corresponding x and y values in the classroom.

U.S. Pat. No. 4,936,020 issued in 1990 to Nablett offers a right angle template for marking a picture mat blank in preparation for subsequent cutting. In addition, U.S. Pat. No.

5,404,648 issued in 1995 to Taylor, Jr., presents a triangular shaped navigational plotter for determining the position of a ship. However, these devices are of no benefit to the math student when plotting points on a graph.

Finally, templates having radian or angular calibrations coupled with one or more straight-edges are sometimes used by math teachers. However, these do not have ruler members or straight edges at a fixed right angle to one another and, accordingly, do not provide the math student with the most efficient means for identifying corresponding values in the domain and the range of a function by allowing for perpendicular alignment of the template with both the x and y axis simultaneously.

It is clear that a need exists for a device useful for teaching students concepts of algebra, calculus, and other mathematical subjects wherein the plotting and reading of graphs is performed.

Therefore, it is an object of the present invention to provide a template which allows for the quick and accurate identification of corresponding values in the domain and the range of a function by allowing for perpendicular alignment of the template with both the x and y axis simultaneously.

It is a further object of the present invention to provide a device which will assist even elementary school students in understanding the relationship between domain and range elements on a graph.

It is another object of the present invention to provide a device comprising a right angle template which allows for the more expedient plotting of points on a graph.

It is yet another object of the present invention to provide a right angle graphing template which is both easy to use and economical to manufacture.

And yet a further object of the present invention is to provide a graphing template which can also serve as a ruler.

BRIEF SUMMARY OF THE INVENTION

Other objects and advantages of the present invention will become more apparent upon reviewing the detailed description and associated figures of the right angle graphing template. In the apparatus of the present invention, a template is provided having first and second elongated ruler portions. The two ruler portions are perpendicular to one another, and intersect at respective ends in order to form a right angle. Each of the ruler portions has an inside scribing edge and an outside scribing edge. These serve as straight-edges for the user. In addition, each ruler portion has a linear marking which runs the length of the ruler portion, with the two linear markings coming together at a vertex to also form a right angle.

A series of cross-markings is also placed along each of the elongated ruler portions. The cross-markings are in the plane of the ruler portions and are situated perpendicular to the linear markings described above. These cross-markings allow the user to quickly ensure that the right angle graphing template is properly positioned for accurate readings of the x and y coordinates. In this regard, the math student or teacher can align the cross-markings of a ruler portion horizontal to the referenced x or y axis, thereby placing the linear marking within that ruler portion perpendicular to the referenced x or y axis. Indeed, the right angle form of the template allows the two ruler portions to be placed perpendicular to the x and y axis, respectively, simultaneously.

To assist the mathematician in plotting or identifying points on a graph, ports are placed at several points within the template along the linear markings. At least one of these ports is placed at the vertex where the two linear markings intersect.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

Figure 1:
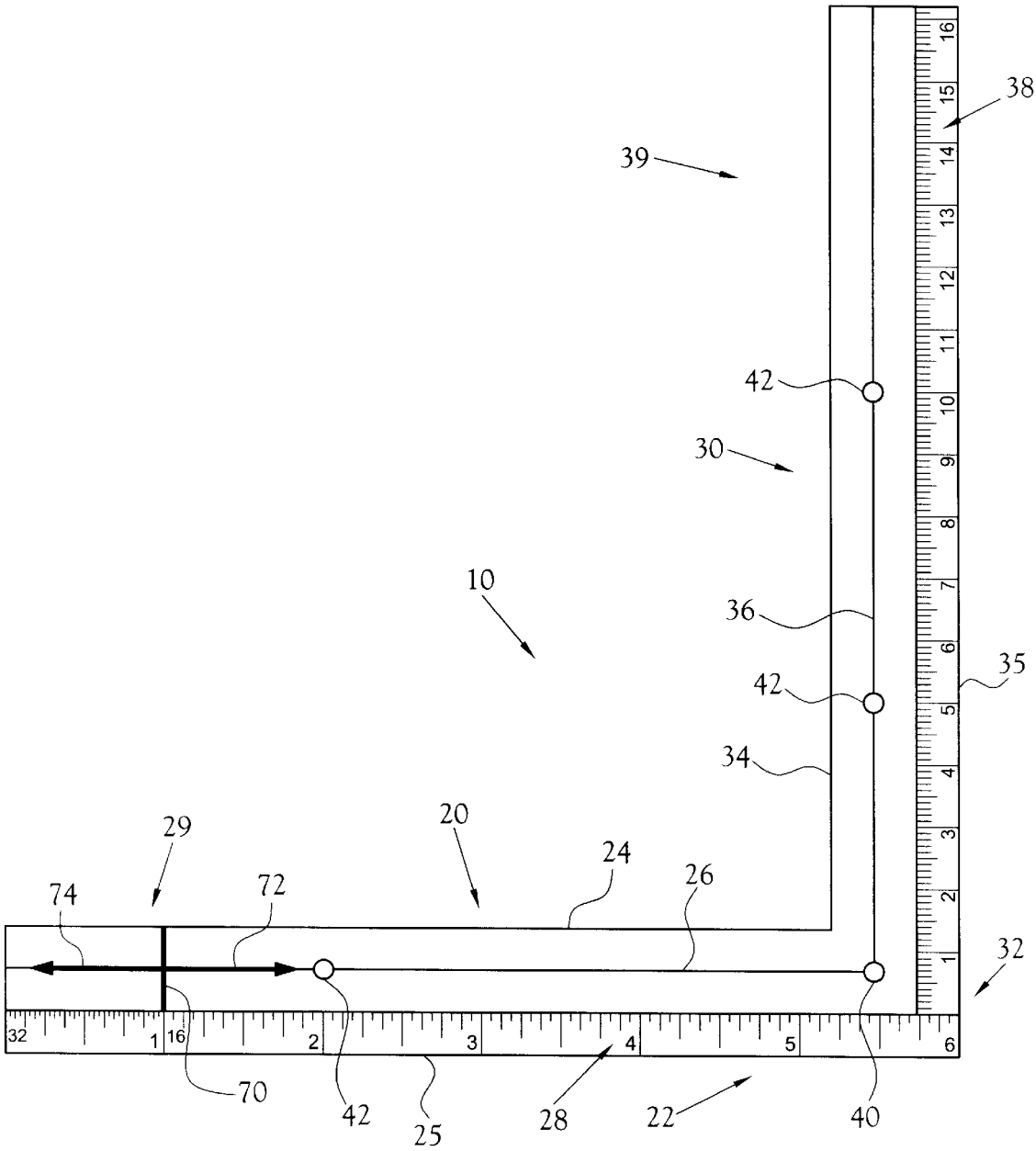
FIG. 1 is a plan view of the right angle graphing template of the present invention, with the two ruler portions being calibrated.

A right angle graphing template of the present invention is illustrated generally at 10 in FIG. 1. The template 10 is designed to assist students in learning a variety of mathematical concepts at different grade levels, including concepts associated with algebra, calculus, and other fields of mathematical study wherein the plotting of points and the reading of graphs is used.

FIG. 1 presents a right angle graphing template 10 of the present invention, having a first elongated ruler portion 20 and a second elongated ruler portion 30. The two ruler portions 20 and 30 are positioned perpendicular to one another and intersect at respective proximal ends 22 and 32 in order to form a right angle. The first ruler portion 20 has an inside scribing edge 24 and an outside scribing edge 25, which serve as straight-edges for the user. The second ruler portion 30 likewise has an inside scribing edge 34 and an outside scribing edge 35, to also serve as straight-edges for the user. The inside 24 and outside 25 scribing edges of the first ruler portion 20 are parallel to one another, while the inside 34 and outside 35 scribing edges of the second ruler portion 30 are also parallel to one another.

Figure 2:
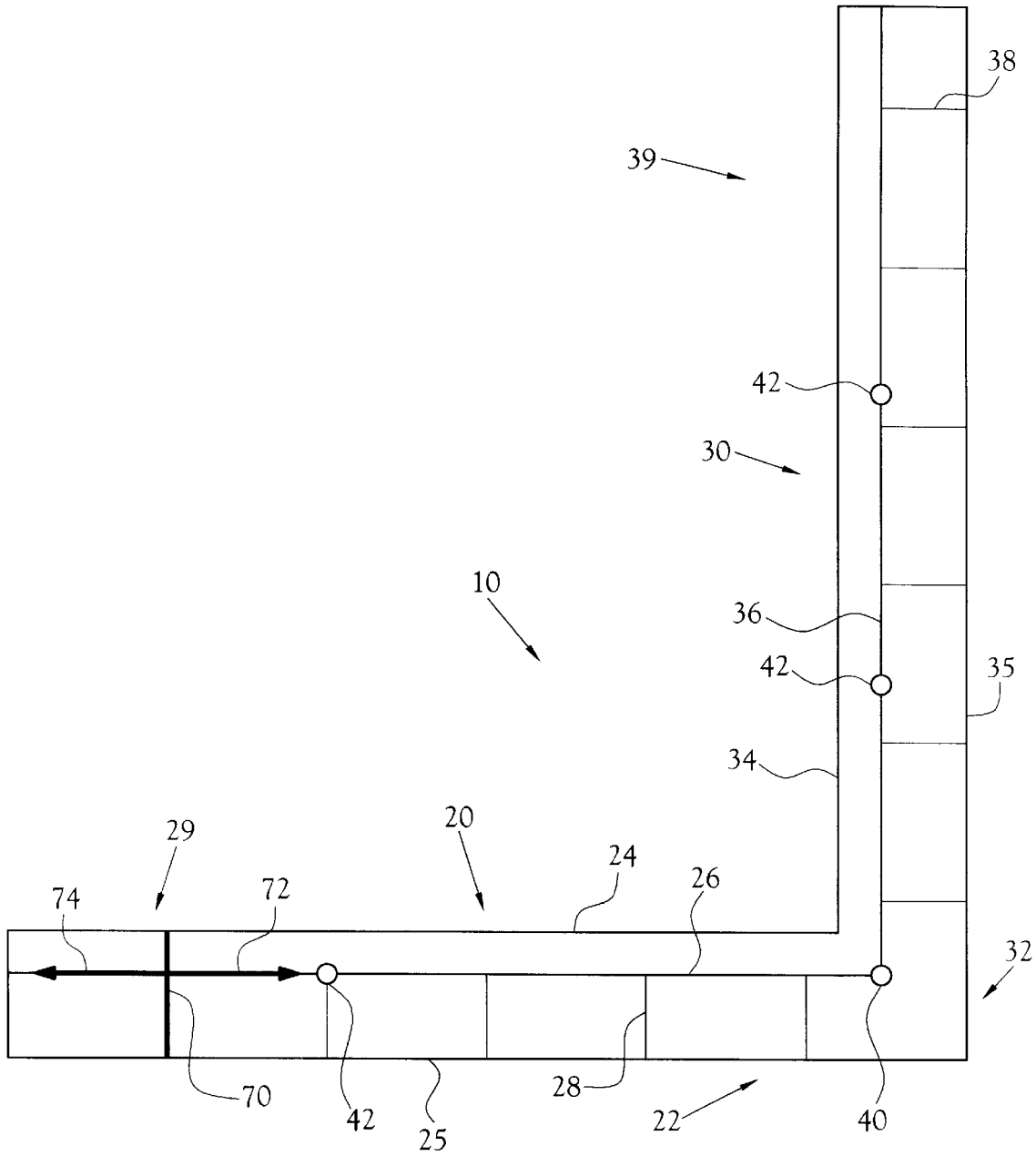
FIG. 2 is a plan view of the right angle graphing template of the present invention, in an alternate embodiment, with the two ruler portions not being calibrated.

A first linear marking 26 is placed along the length of the first ruler portion 20. A second reciprocal linear marking 36 is placed along the length of the second ruler portion 30. The two linear markings 26 and 36 meet at proximal ends 22 and 32 of the ruler portions 20 and 30 in order to form a right angle. It will be noted from FIG. 1 and FIG. 2 that the two linear markings 26 and 36 are positioned somewhat central to the respective ruler portions 20 and 30. However, the exact positioning of the linear markings 26 and 36 is not critical, so long as first linear marking 26 is positioned between and parallel to the inside 24 and outside 25 scribing edges of the first ruler portion 20, and second linear marking 36 is positioned between and parallel to the inside 34 and outside 35 scribing edges of the second ruler portion 30. In addition, the first 26 and second 36 linear markings are perpendicular to one another.

Figure 4:
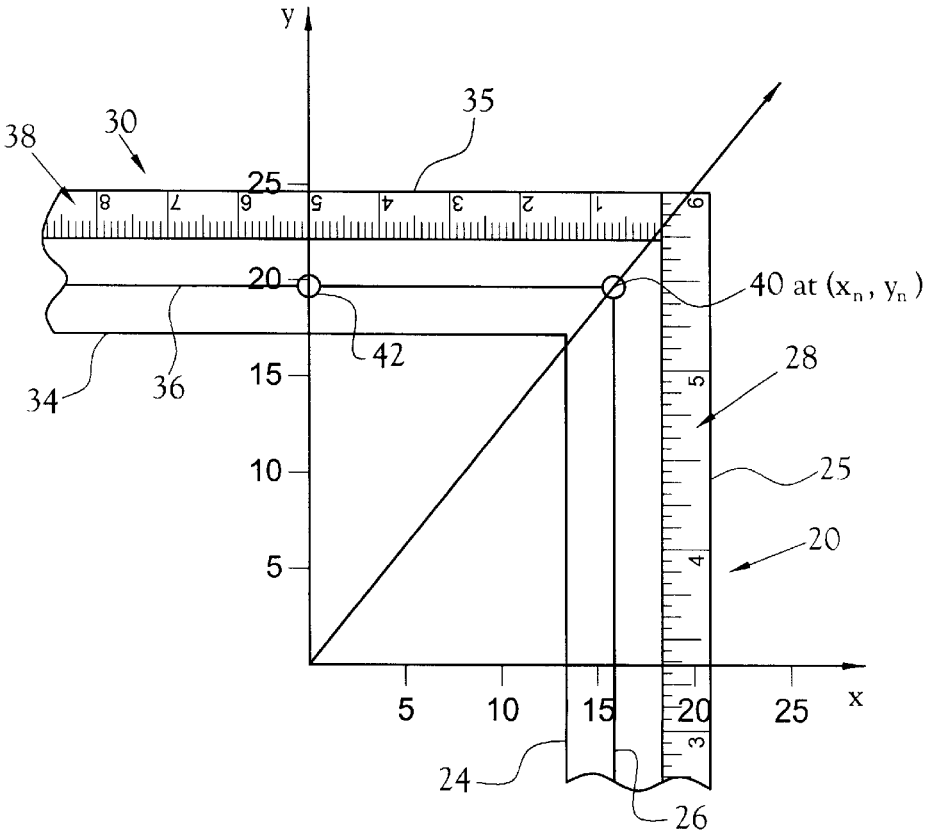
FIG. 4 presents the right angle graphing template of the present invention being used to simultaneously identify x and y coordinates at a point on a graph.

Horizontal cross-markings 28 and 38 are also placed along each of the elongated ruler portions 20 and 30. The cross-markings are in the plane of the ruler portions 20 and 30 and are situated perpendicular to the linear markings 26 and 36 described above. These cross-markings allow the user to quickly ensure that the right angle graphing template 10 is properly positioned for accurate readings of the x and y coordinates of a graph. An example is demonstrated in FIG. 4. As shown, the math student or teacher can align the cross-markings 28 or 38 of a ruler portion 20 or 30 horizontal to the referenced x or y axis, thereby placing the linear marking 26 or 36 perpendicular to the referenced x or y axis. As shown in FIG. 4, corresponding x and y values can be determined with one simultaneous positioning of the graphing template 10.

In the preferred embodiment, the horizontal cross-markings 28 and 38 are calibrated. On the first ruler portion 20, the calibration 28 is in inches. On the second ruler portion 30, the calibration 38 is in centimeters. However, those skilled in the art will understand that any unit of measurement may be applied to the first 20 and second 30 ruler portions. The calibrations 28 and 38 extend into the ruler portions 20 and 30 a sufficient amount to allow the user to align the calibrations 28 and 38 horizontally with the x or y axis.

Figure 3:
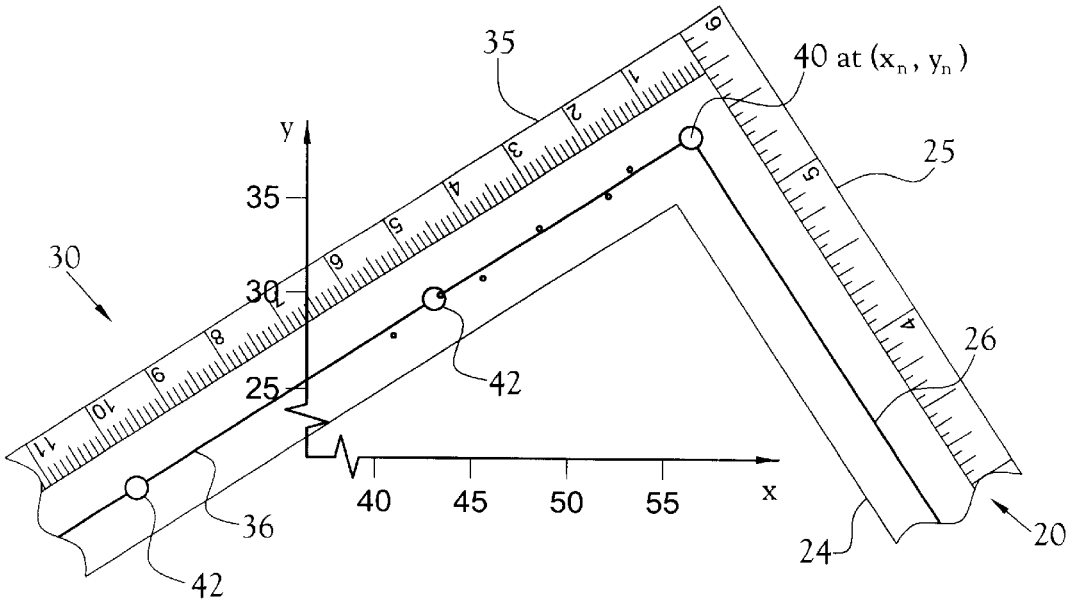
FIG. 3 presents the right angle graphing template of the present invention being used to draw a best-fit line from a scatter plot on a graph.

To assist the mathematician in identifying points on a graph, a port 40 is placed within the template 10 at the vertex where the two linear markings 26 and 36 intersect. In the preferred embodiment, at least two additional ruler ports 42 may be placed at points on the linear markings 26 and 36, respectively, proximal to the distal ends 29 and 39 of the ruler portions 20 and 30. These ports 42 further assist the math student in plotting points on a graph, as depicted in FIG. 3.

In order to locate corresponding x and y values on a graph, the student should first place the vertex port 40 at a point on the graph, as shown in FIG. 4. The right angle graphing template 10 is then oriented so that the linear markings 26 and 36 intersect the x and y axis. Using the calibration markings 28 and 38 as a reference, the position of the right angle graphing template can be adjusted to ensure that the linear markings 26 and 36 are perpendicular to the x and y axis. Then, as shown in FIG. 4, corresponding values of x and y can be quickly and accurately identified.

A student can also use linear marking 36 to identify a line of best fit and to calculate the slope of the best-fit line. This is demonstrated in FIG. 3. The student first orients linear marking 36 to a best-fit line. FIG. 3 demonstrates the use of linear marking 36 for this purpose. The student then makes points on the best-fit line using ports 40 and 42. Connecting the points made at ports 40 and 42 creates a best-fit line. The slope of the best-fit line can then be determined as shown in FIG. 4. In this regard, the right angle graphing template 10 is oriented so that the linear markings 26 and 36 intersect the x and y axis normal to these axis. A perpendicular orientation can be achieved by using the horizontal cross-markings 28 and 38 as shown in FIG. 4. Corresponding $x_1$ and $y_1$ values are then determined. This process is repeated to obtain $x_2$ and $y_2$ values. The slope m can then be calculated.

To assist the mathematician in plotting or identifying points on a graph, the graphing template is fabricated from an essentially transparent material. The preferred material is a polymer or other shatter resistant plastic. A tint is added to the material of the graphing template 10 to make it more visible against white paper.

Figure 5:
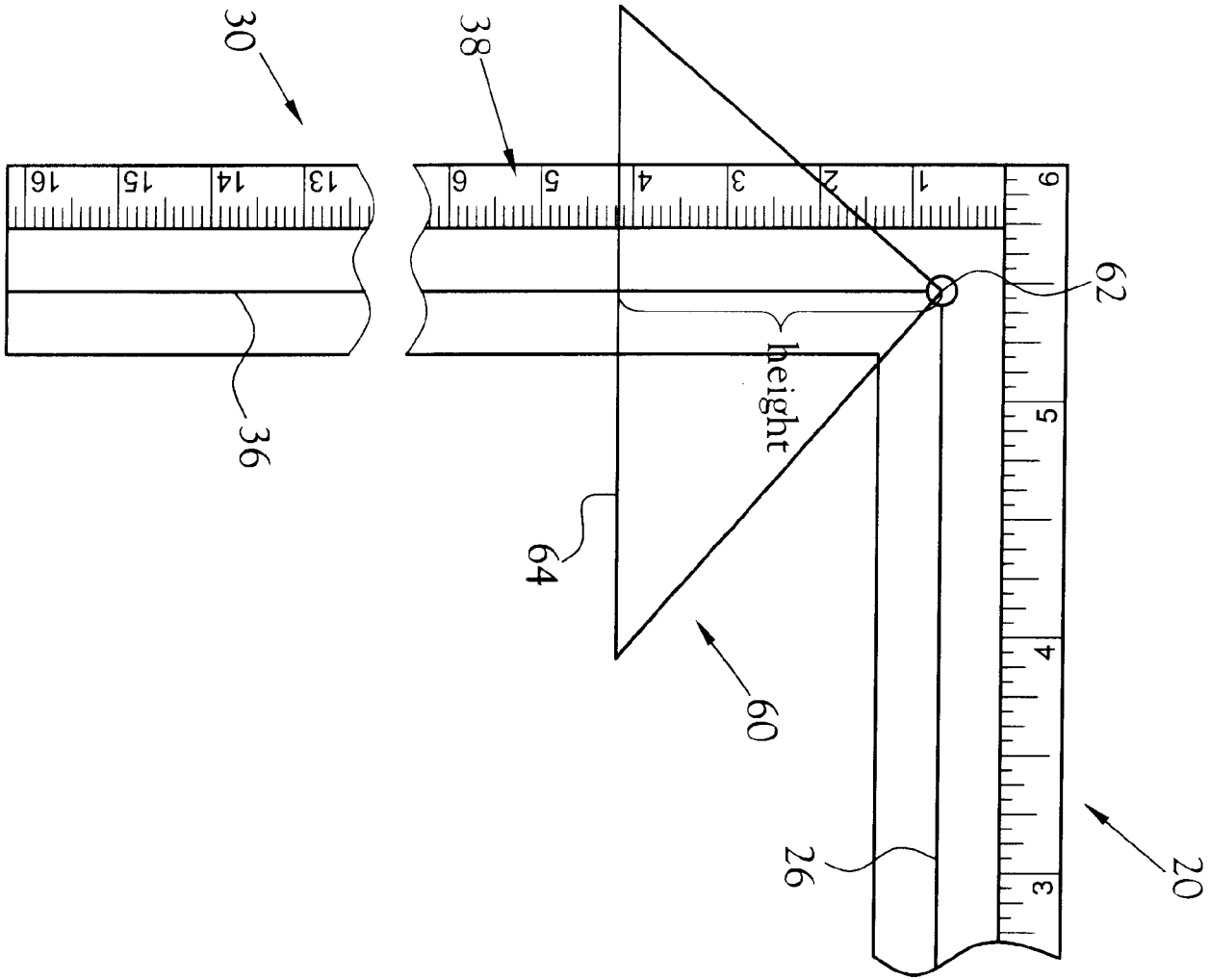
FIG. 5 presents the right angle graphing template of the present invention as being used to identify the height of a geometric figure.

Those skilled in the art will understand that other uses of the right angle graphing template exist. For example, the right angle graphing template 10 can be used to determine the altitude of a triangle 60, as shown in FIG. 5. To accomplish this purpose, the vertex port 40 of the right angle graphing template 10 is positioned over the peak 62 of a triangle 60. Linear marking 36 is then directed towards the base 64 of the triangle 60. Using the cross-markings 38, the user then orients linear marking 36 perpendicular to the base 64 of the triangle 60. A marking is then made in port 42 within linear marking 36. A line can then be made connecting the peak 62 of the triangle 60 with the marking, thereby enabling the student to accurately measure the height of the triangle 60.

As an additional feature within the right angle graphing template 10, up and down arrows 72 and 74 are placed at the distal end 29 of the first ruler portion 20. The arrows 72 and 74 are placed along linear marking 26, and perpendicular to a cross-marking designated as the inequality line 70. The arrows 72 and 74 assist in teaching the algebra student about inequalities. In this respect, the arrows will direct the student as to which portion of a graph to shade as representing the values of the range. When the inequality is expressed in slope-intercept form, the arrow that points up identifies the area for "y greater than" and the arrow that points down identifies the area for "y less than."

Figure 6A:
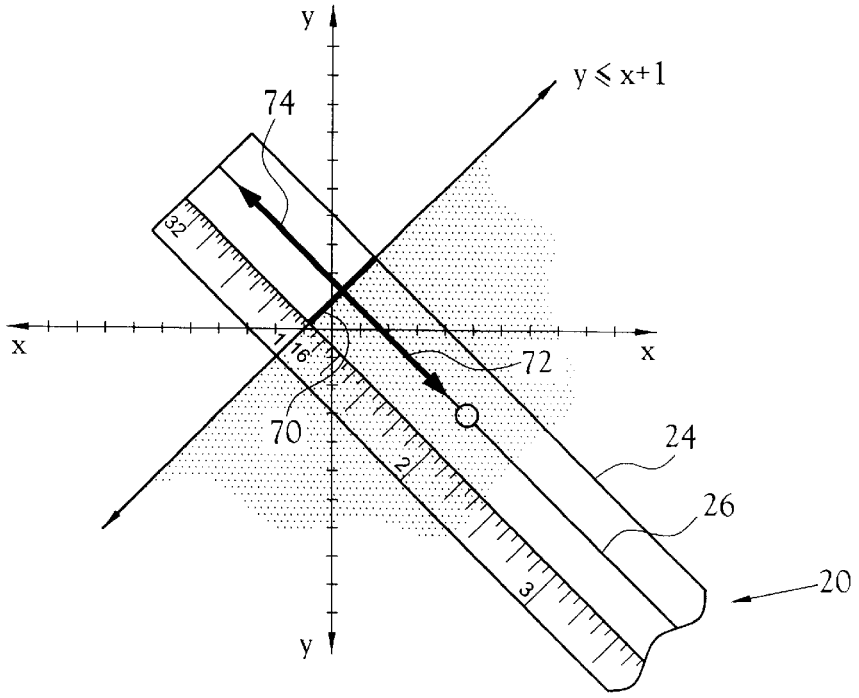
FIGS. 6(*a*) and 6(*b*) show the use of arrows within the right angle graphing template of the present invention to teach inequalities, with FIG. 6(*a*) showing $y \leqq x+1$, and FIG. 6(*b*) showing $y \geqq 4x-8$.
Figure 6B:
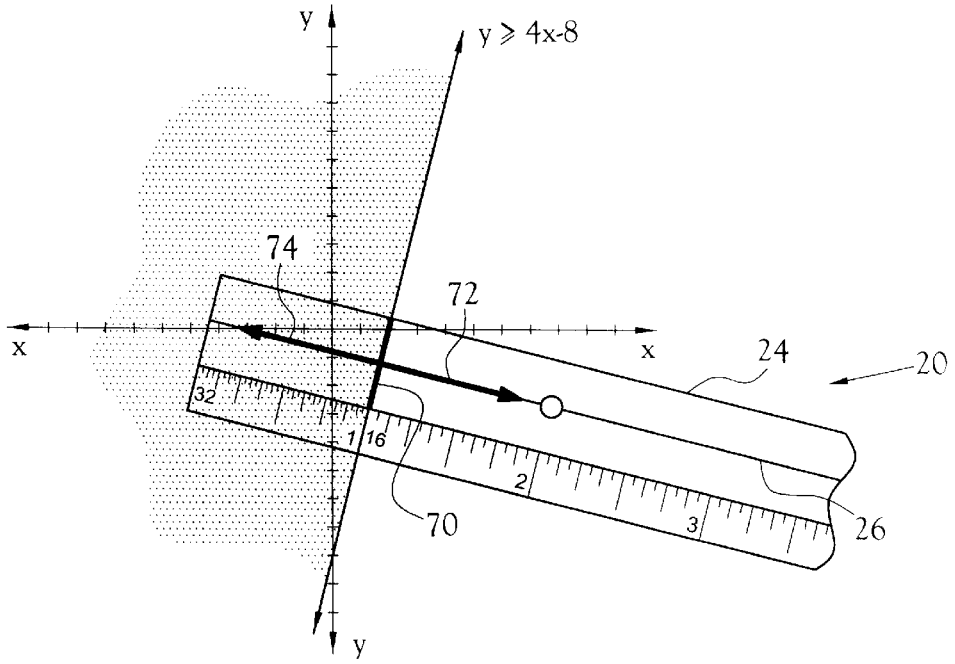

FIG. 6(*a*) and FIG. 6(*b*) demonstrate placement of inequality line 70 onto a graphed line. As shown in FIG. 6(*a*), the down arrow 72 indicates to the student the graphical area of $y \leqq x+1$. The student would then shade the area below the graphed line, as shown. FIG. 6(*b*), shows the use of the up arrow 74 to indicate the graphical area of $y \geqq 4x-8$. The student would then shade the area above the graphed line, as shown.

From the foregoing description, it will be recognized by those skilled in the art that a template offering advantages over the prior art has been provided. While a preferred embodiment for the foregoing has been shown and described, it will be understood that the description is not intended to limit the disclosures, but rather is intended to cover all modifications and alternate methods falling within the spirit and the scope of the invention as defined in the appended claims. For example, those skilled in the art will understand that the number and placement of ports 42 along the linear markings 26 and 36 may vary.

Having thus described the aforementioned invention, I claim:

1. A graphing template comprising:

a first ruler portion having a proximal end and a distal end, and also having an inside scribing edge and an outside scribing edge, with said inside and outside scribing edges of said first ruler portion being parallel to one another, wherein said first ruler portion further comprises at least one ruler port positioned on said first linear marking proximal to said distal end of said first ruler portion and an inequality line positioned perpendicular to said first linear marking proximal to said distal end of said first ruler portion, and wherein up and down arrows are placed on said first linear marking to indicate direction with respect to said inequality line;

a second ruler portion having a proximal end and a distal end, and also having an inside scribing edge and an outside scribing edge, wherein said inside and outside scribing edges of said second ruler portion are parallel to one another, and wherein said inside scribing edge of said second ruler portion intersects with said inside scribing edge of said first ruler portion at said proximal ends of said first and second ruler portions to form a 90 degree angle, wherein said second ruler portion further comprises at least one ruler port positioned on said second linear marking proximal to said distal end of said second ruler portion, wherein said first ruler portion and said second ruler portion of said graphing template are fabricated from a transparent material;

a first linear marking within said first ruler portion positioned between and parallel to said inside and outside scribing edges of said first ruler portion;

a second linear marking within said second ruler portion positioned between and parallel to said inside and outside scribing edges of said second ruler portion, and wherein said second linear marking is perpendicular to and intersects said first linear marking at a point;

a vertex port in said proximal ends of said first and second ruler portions at the point of intersection of said first linear marking and said second linear marking;

a series of cross-markings within said first ruler portion perpendicular to said first linear marking; and a series of cross-markings within said second ruler portion perpendicular to said second linear marking.

* * * * *